United States Patent [19]

Dickinson

[11] Patent Number: 4,576,508

[45] Date of Patent: Mar. 18, 1986

[54] BOLLARD TRAFFICWAY BARRIER AND VEHICLE ARREST SYSTEM

[76] Inventor: Harry D. Dickinson, 1681 Larco Way, Glendale, Calif. 91302

[21] Appl. No.: 679,079

[22] Filed: Dec. 6, 1984

[51] Int. Cl.[4] ..... E01F 13/00; E01F 15/00

[52] U.S. Cl. ..... 404/6; 49/49; 49/131; 404/11; 256/DIG. 5

[58] Field of Search ..... 404/6, 11; 49/35, 49, 49/131; 256/1, 13.1, DIG. 5; 212/268, 269; 254/93 L

[56] References Cited

U.S. PATENT DOCUMENTS 3,086,430 4/1963 Emmel ..... 404/6
3,462,023 8/1969 Grove ..... 212/268
3,660,935 5/1972 Boots ..... 49/35
4,490,068 12/1984 Dickinson ..... 404/6

*Primary Examiner*—Stephen J. Novosad
*Assistant Examiner*—John F. Letchford
*Attorney, Agent, or Firm*—William H. Maxwell

[57] ABSTRACT

A bollard type trafficway barrier for arresting vehicles, comprised of a cast in place foundation and a mounting frame replaceable therein to carry a lift means for the bollard that is directionally oriented with respect to traffic so as to withstand great impacts, and with access for replacement of the bollard, extension and retraction being instantaneous by impact resistant fluid power and controls, the installation being flush with the grade when retracted and the bollard being remotely controlled for above grade extension and retraction.

30 Claims, 11 Drawing Figures

BOLLARD TRAFFICWAY BARRIER AND VEHICLE ARREST SYSTEM

BACKGROUND

This invention relates to anti terrorist barricades capable of stopping the movement of vehicles unauthorized to enter a trafficway. A vehicle moving toward such a barricade has a certain kinetic energy which is a measure of the hitting power it posseses. This kinetic energy is calaculated from the vehicle weight and velocity, and on impact with such a barrier the kinetic energy is then converted into heat, sound and deformation of the vehicle, and in some cases deformation of the barrier. In actual practice, the total energy dissipation depends upon varying factors prevailing at the moment of impact, all of which need not be detailed here. However for example, a vehicle moving at 50 mph has twenty five times as much kinetic energy as it would have moving at 10 mph; or for example an armored car weighing thirty times as much as a small passenger car and moving at 10 mph would have less kinetic energy than said passenger car moving at 60 mph. It is within this approximate range of kinetic energy with which this invention is primarily concerned, it being a general object to provide a retractile bollard that is configured to provide maximum protection against vehicle assault within a minimum package or installation area.

In accordance with this invention, the bollard is a structural steel fabrication that is lifted into working position by a directly coupled double acting cylinder and piston means, so that it can be positively extended and retracted. The geometry of the bollard is disposed and rotatably oriented so that the energy of impact is efficiently transmitted into a rugged foundation that absorbs said energy, within its elastic limit that exceeds the rupture point of the bollard under the same impact conditions. Accordingly, under major impact conditions the bollard per se may be damaged or destroyed and it is therefore considered to be expendable and adapted to be readily replaced. It is an object of this invention, therefore, to provide a barrier of unit construction wherein the components thereof are individually replaceable.

The retractile bollard of the present invention is characterized by the aforesaid foundation and by a mounting frame by which the bollard is installed in said foundation. A feature is the flush trafficway condition of this barrier unit, when the bollard is retracted, and to this end the assembled condition of components as they are dislosed herein provides the accessability for disassembly and repair, service and replacement. It is an object of this invention to provide for this accessability and replaceability.

The bollard is power operated by lift means, preferably a hydraulic power and electrical control system later described. However, the term "lift means" is to include such means as screw jack, chain and sprocket, cable and drum, and rack and pinion, or the like lift means. In practice, operation is from bottled gas, by air from a compressor and/or reservoir of compressed air, or by a hydraulic pump or liquid accumulator, as will be described. A feature of this barrier system is its capability of instantaneous operation when circumstances require.

The typical collision point above grade is presumed to be approximately 17 inches, the average height of a vehicle bumper. Accordingly, the bollard is extended well above the point of collision, for example to a height of about two feet, all of which may vary as required. The actuation of the bollard between the vertically extended and the retracted position is by fluid actuator, it being an object to minimize motor power as well as pump rate requirements. With the preferred form of bollard motivation, a fluid pressure accumulator is employed, and wherein liquid is stored between predetermined high and low pressure levels, as potential energy available for instantaneous action. As disclosed herein, there is a high-low pressure sensor that automatically controls operation of the motor pump means that maintains a predetermined range of pressure in an accumulator. The lift motor for the bollard is a positive displacement hydraulic cylinder and piston means, activated through electrically energized valves for instantaneous response. The hydraulic lift system used herein is the subject of my copending application Ser. No. 488,106 filed Apr. 25, 1983, entitled HYDRAULIC SAFETY BARRIER TRAFFICWAY CONTROLLER, issued Dec. 25, 1984 as U.S. Pat. No. 4,490,068.

A feature of this barrier unit installation is that it is self bailing and rids itself of the accumulation of surface waters. By cycling the barricade bollard, most of the surface water entering into the foundation pit can be forced out. If there is no gravity drain or pump out, the water level after cycling will be minimized. This is below any of the moving elements but may be above the clevis of the cylinder. Although some oxidation may occur at the clevis, only long term exposure will adversely affect operation. A permanent drainage means is preferable as shown, so that all waters are disposed of.

SUMMARY OF THE INVENTION

The bollard type barricade disclosed herein is a power elevated and power retracted barrier that is mounted below grade within a cast in place foundation, preferably a steel cylinder that provides a pit. A mounting frame drops into the foundation cylinder with first guide means to rotatably orient the power operable lift means for coupled engagement with the bollard. And the bollard per se is then received by the foundation cylinder, and is centered therein over the power operable lift means by a second guide means to coordinate with the first guide means and rotatably orient the internally reinforced structure of the bollard with the direction of vehicular movement along the trafficway to be protected.

The foregoing and various other objects and features of this invention will be apparent and fully understood from the following detailed description of the typical preferred form and application thereof, throughout which description reference is made to the accompanying drawings.

Figure 11:
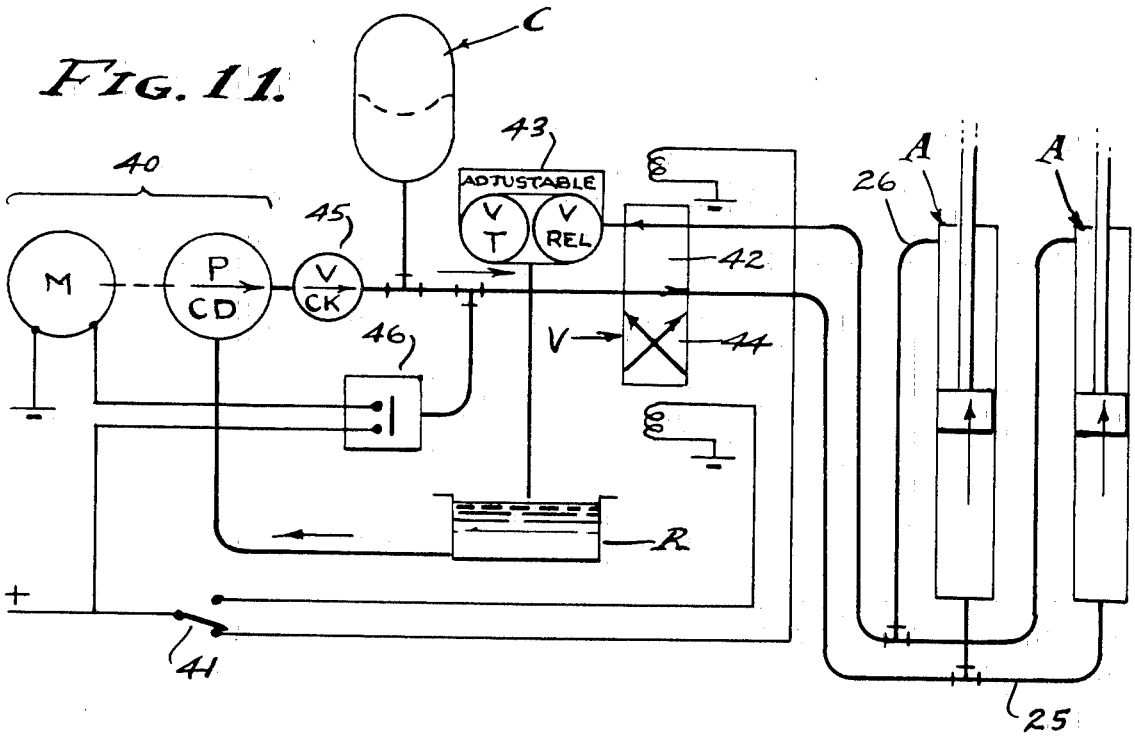

And, FIG. 11 is a schematic diagram of the hydraulic and electrical control system for instantaneous operation of the barricade.

PREFERRED EMBODIMENT

Figure 1:
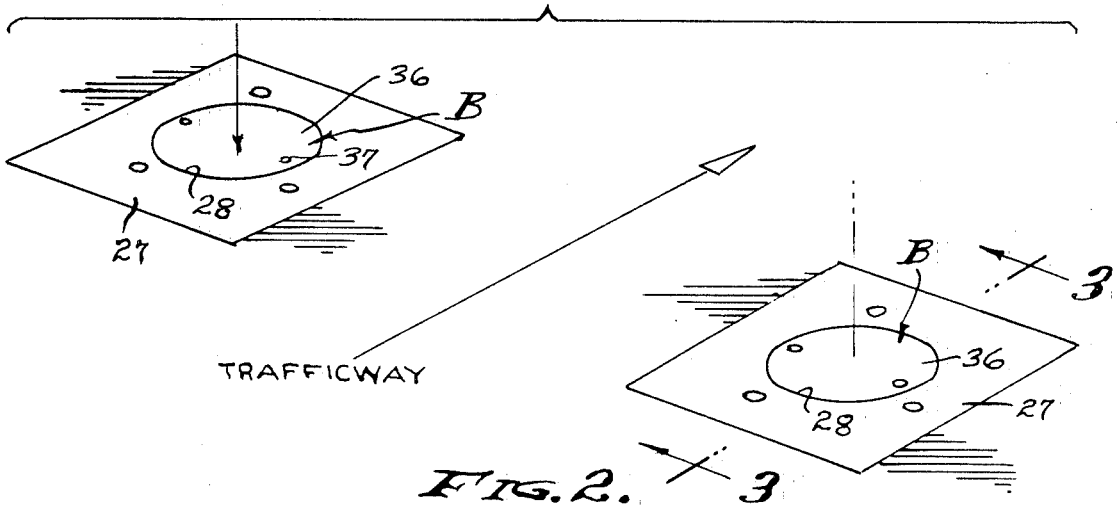
FIGS. 1 and 2 are perspective views of the trafficway barrier installation, FIG. 1 showing the bollard retracted, and FIG. 2 showing the bollard extended.
Figure 2:
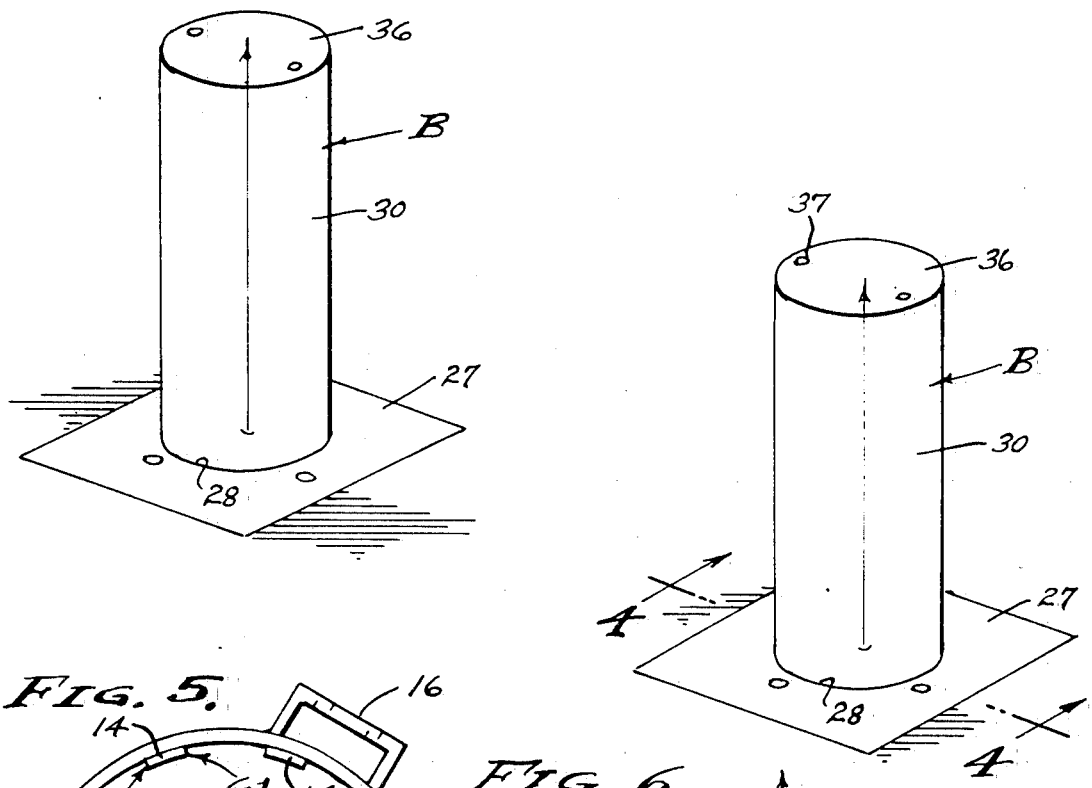

Referring now to the drawings, FIG. 1 shows the retracted condition of a pair of bollards B placed for the obstruction of traffic movement in the direction of the arrow. Note that all features of the installation of this barrier unit are below grade. In FIG. 2 is shown the elevated or extended condition of the pair of bollards B, each extending to a height well above the grade or trafficway surface. In practice, elevation and retraction of these bollards in simultaneous and occurs during a time span of approxiamtely 0.6 to 5 seconds, as may be required and according to the power source made available.

Figure 5:
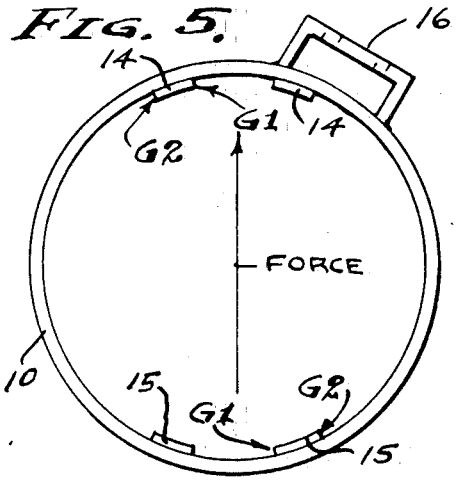
FIGS. 5 and 6 are enlarged detailed sectional views, FIG. 5 being a detail of the foundation taken as indicated by line 5—5 on FIG. 4, and FIG. 6 being a detail of the bollard taken as indicated by line 6—6 on FIG. 4.
Figure 8:
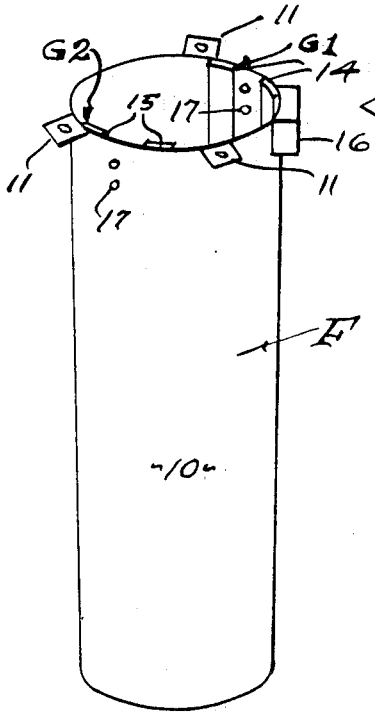
FIGS. 8, 9 and 10 are perspective views of the three principal structural components that make up this barrier installation.
Figure 9:
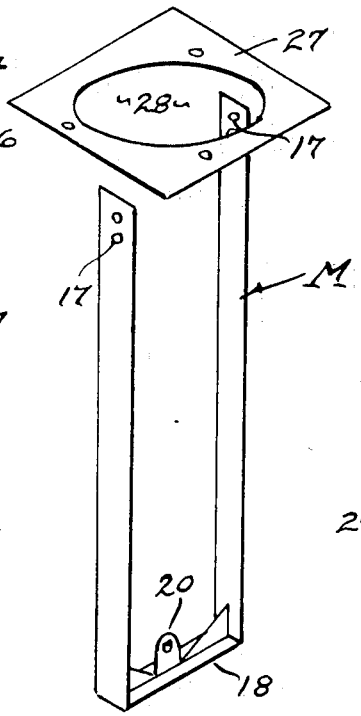
Figure 10:
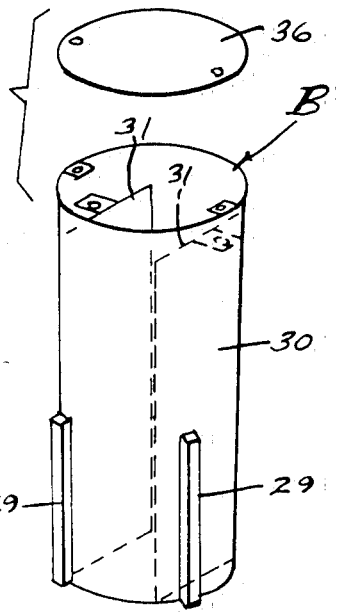

As shown in FIGS. 8, 9 and 10 of the drawings, each barrier unit as shown in FIGS. 1 and 2 is comprised generally of a foundation F, a mounting frame M, the bollard B, and a power operable lift means A to operate the bollard. The foundation F is permanently installed below grade, as by casting it in place in concrete as clearly shown in FIGS. 3 and 4. The foundation F is of tube form, and preferably of cylinder cross section disposed on a central vertical axis along which the bollard B is extended and retracted. The foundation F has a peripheral wall 10 open at the grade level with mounting flanges 11 flush with the grade, and closed at its lower end by a bottom 12 through which there is a drain 13. The drain 13 can by coupled to a drain pipe or simply open to a leaching bed of gravel or the like. A first guide means G1 extends vertically at the interior of the wall 10 to guide and rotatably orient the mounting frame M, and a second guide means G2 extends vertically at the interior of the wall 10 to guide and rotatably orient the bollard B. In practice, the guide means G1 and G2 are incorporated in circumferentially spaced rails 14 and 15 provided in spaced parallel pairs disposed at diametrically opposite inner sides of the foundation cylinder, each pair being in alignment with the vehiclular movement (see arrows in FIGS. 1, 5 and 6), and coincidental with the expectant direction of traffic flow and impact (force). The two pairs of rails 14 and 15 are coextensive with the height of the tubular foundation F. A plumbing access box 16 is provided at the outer side of the foundation tube wall, for entry of the hydraulic lines later described.

The mounting frame M is a hanger-type structure that depends into the foundation tube, anchored to the top end of the foundation wall 10 as by fasteners at 17 and providing a support 18 at the bottom end of the foundation to carry the power operable lift means A. A feature is the rotational orientation of the mounting frame M by the first guide means G1, and as shown by the spaced pairs of guide rails 14 and 15 at opposite fore and aft sides of the wall 10. Accordingly, the mounting frame M is aligned with the trafficway and impact forces to be expected. The support 18 is comprised of a transverse member that carries an upstanding tongue 20 to which a clevis 21 of a power cylinder is attached by a pin 22 to stand within the foundation tube on the central axis thereof. With the power operable lift means A so attached and the mounting frame M lowered into and fastened to the walls of the foundation F, the barrier unit is ready for hydraulic connection and for insertion of the bollard B.

Figure 4:
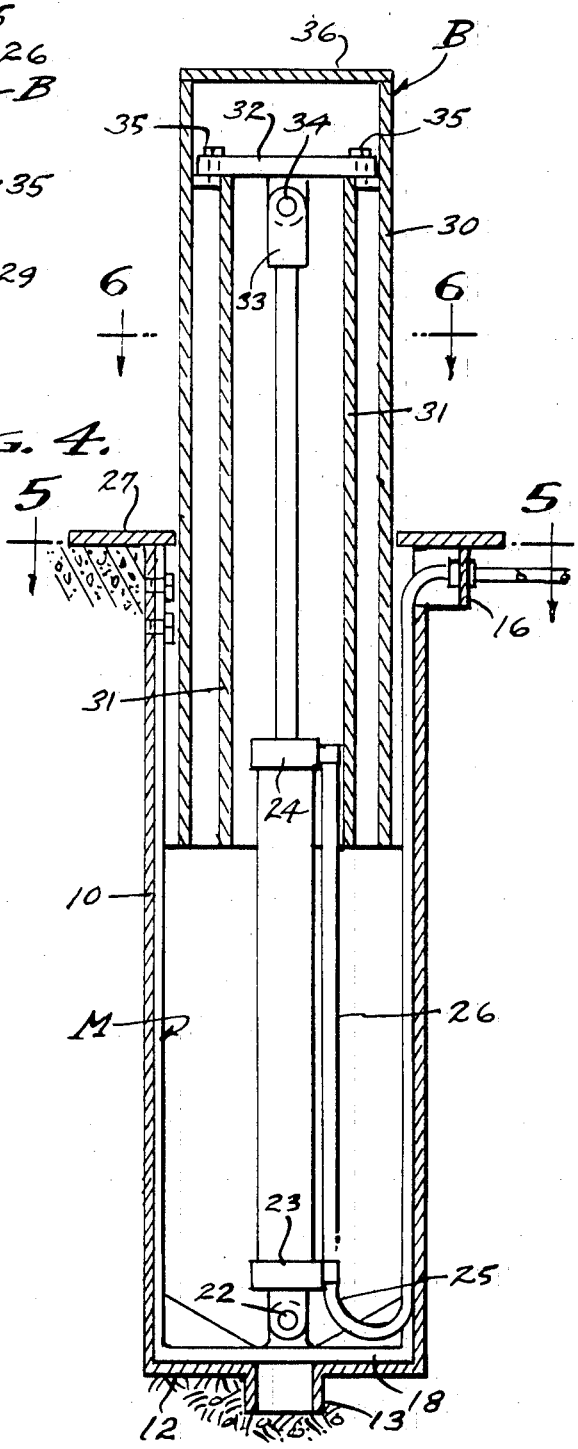
FIG. 4 is an enlarged sectional view taken as indicated by line 4—4 on FIG. 2.

Hydraulic operation of the power operable lift means A is double acting, although a single acting lift and gravity retraction of the bollard is feasible. As shown, there is a fluid connection to both the bottom and top heads 23 and 24 of means A, through lines 25 and 26 that extend upward from the bottom 12 to the box 16, as shown in FIG. 4. Note that the top head line 26 loops downward from head 24 alongside the actuating cylinder and then upward alongside the foundation wall 10. Thus, the open skirt of the bollard, next described, clears the hydraulic line 26 when retracted.

Figure 7:
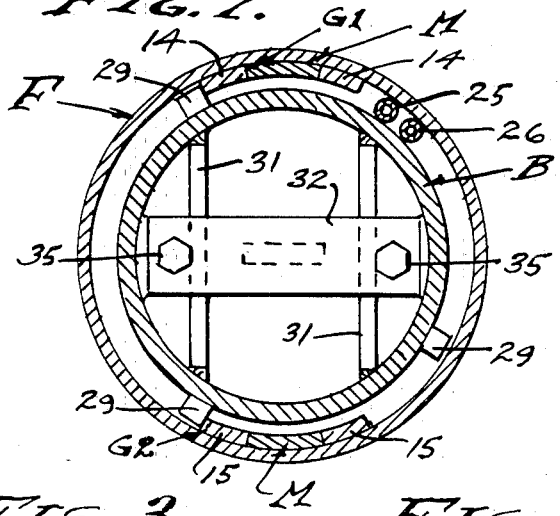
FIG. 7 is an enlarged detailed sectional view taken as indicated by line 7—7 on FIG. 3.
Figure 3:
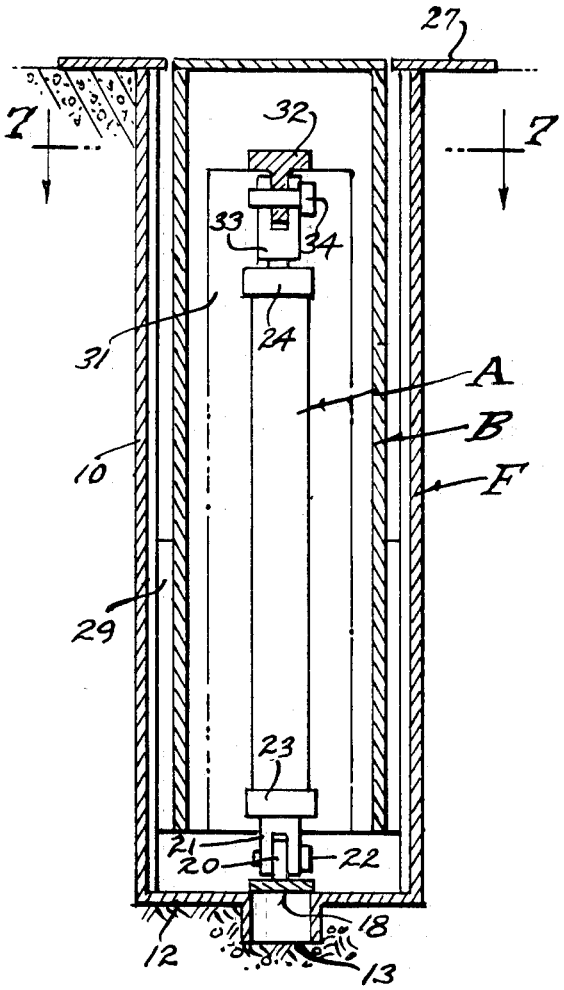
FIG. 3 is an enlarged sectional view taken as indicated by line 3—3 on FIG. 1.

The bollard B is a reinforced tube structure, and preferably of cylinder cross section coaxially disposed within the confines of the foundation F when retracted as shown in FIG. 3. When the bollard is extended it projects along the vertical axis as shown in FIG. 4. As best illustrated in FIG. 7 there is an annulus between the concentric foundation F and the bollard B, to accomodate the mounting frame M, the guide means G1 and G2, and the hydraualic lines 25 and 26. A deck plate 27 with a clearance opening 28 therethrough passes the bollard and closes the annulus. The deck plate is secured to the foundation flanges by screw fasteners as shown.

Guide engageable runners 29 project from and extend along the lower portion of the bollard exterior wall 30. The guide runners 29 are parallel with the axis of the unit, and at least one runner 29 is engageable with the guide means G2. As shown, there are three runners 29 and two of which are circumferentially spaced to slideably engage with opposed faces of the above described rails 14 and 15. This runner and rail engagement within the confines of the cylinder wall 10 of the foundation F maintains the vertical disposition of the bollard and it simultaneously orients the bollard to the direction of vehiclular movement.

Figure 6:
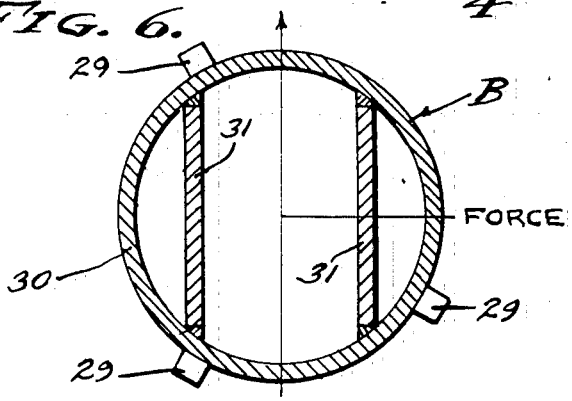

In accordance with this invention, the bollard B is a structurally reinforced member adapted to resist impact in the direction of trafficway movement of vehicles to be stopped. Accordingly, the interior of the bollard B is provided with reinforcement means disposed to efficiently strengthen the bollard in alignment with the direction of trafficway movement. For example, a square tube with its corners coextensively engaged with and/or welded to the inner wall of the bollard greatly resists collapse thereof, or disc-shaped transverse bulkheads at frequent intervals therein resist collapse. As shown, at least one and preferably a pair of planar webs 31 are disposed vertically and coextensively of the bollard cylinder between opposite front and back interior wall surfaces thereof and in planes parallel to the direction of trafficway vehicle movement. As shown in FIGS. 6, 7 and 10, the webs are substantially coextensively integral with the bollard wall 30 to form a box section characterized by the planar walls 31 that provide great strength in the direction of vehicle impact.

Final assembly of the barrier unit is made by dropping the bollard B into the foundation F and over the power operated lift means A supported therein by the mounting frame M. A header 32 is then attached to the piston rod clevis 33 by a pin 34, after which the header 32 is fastened to the bollard at the reinforcement webs 31 by screw fasteners 35. A cover plate 36 is then secured to close the top end of the bollard B as by means of screw fasteners 37.

The fluid power supply is remote and extends from the box 16 to a controlled fluid power supply as shown in FIG. 11 of the drawings. The preferred power source is of intermittent running potential energy form with hydraulic actuation in the form of a fluid pressure source applied from a time-demand reduced power motor driven pump means 40 and directed by a four-way two-position valve menas V from a pressure-volume accumulator C to opposite ends of a double acting cylinder and piston lift means A, so as to extend and retract the bollard B through the application of positive fluid pressure with impact absorbing capability. This is a pressure-volume accumulation and impact absorbing system with UP-DOWN selector switch or switches 41 shown having double throw contacts with an UP position solenoid positioning the valve V as shown at 42 and with a DOWN position solenoid positioning the valve V as shown at 44. The UP and DOWN contacts can hold the solenoids operated, directly or indirctly by relay means or the UP and DOWN contacts can be made instantanesouly and positions held by friction or detent action.

A motor M drives a positive displacement pump P, both of substantially reduced capacity. In practice, the motor M and pump P are employed and operated intermittently upon demand, responsive to a high-low switch 43 that senses accumulator pressure proportionate to volume therein. The positive displacement pump P increases pressure in the accumulator C through a check valve 45 that protects the pump P from hydraulic impact and secures the cylinder and piston means A in either the extended or retracted position. The pressure-volume accumulator C employed is a gas charged accumulator with a diaphragm as indicated, and is operated between 300 lbs. and 1500 lbs. pressure per square inch and connected into the delivery line to valve V. In accordance with this invention, a high-low switch 46 is open hydraulically to the accumulator pressure so as to sense the pressure-volume condition thereof, and operates to close the energizing circuit to motor M at said 300 lbs. pressure, and to open the energizing circuit to motor M at said 1500 lbs. pressure.

A feature of this system is the uniform speed control and impact absorbing capability at variable pressure, to the piston of the means A, by the inclusion of an adjustable flow regulating pressure relief valve 43 in the return line from valve V to the reservoir R. Accordingly, the relief valve 43 protects the hydraulic system and the barrier structure from impacts imposed upon the bollard B. Valve 43 is an adjustable flow regulator and thereby controls and establishes a uniform rate of movement regardless of variations in fluid supply pressure from the accumulator C. Accordingly, the velocity at which the bollard B moves when extended or retracted is adjustable to remain substantially the same between the low supply and high supply pressures. The flow regulating pressure relief valve 43 serves multi purposes, firstly speed control, secondly impact absorbing, and thirdly positively prevents retractions with a set pressure limit of the piston in either the up or down mode.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. A vertically extensible and retractile bollard type trafficway barrier for arresting vehicles, and including;

a below grade level foundation of substantial depth and having an open upper end at grade level and having a vertically disposed guide means extending between said open upper end and a bottom thereof, a mounting frame removeably inserted into the foundation through and suspended from the open upper end of the foundation and having a support over the bottom of the foundation, the support having a centered attachment carrying a power operable lift means disposed on a vertical operational axis, a bollard of tube form centered over the power operable lift means and within the foundation and slideably engageable with said guide means for vertical disposition, the upper end of the bollard being accesible and coupled to a reciprocating rod of the power operable lift means to extend the top of the bollard from a retracted position flush with the grade level, and controlled power means to actuate the power operable lift means for reciprocation of the rod and bollard between extended and retracted positions.

2. The trafficway barrier as set forth in claim 1, wherein the foundation is of tube form comprised of vertically disposed side walls closed by the bottom and the guide means comprised of at least one rail, and wherein the bollard is a fabrication comprised of vertically disposed tube walls centered in the foundation tube form and with runners slideably engageable with the foundation side walls and at least one runner engageable with said at least one rail.

3. The trafficway barrier as set forth in claim 1, wherein the foundation is of tube form fabrication comprised of vertically disposed side walls closed by the bottom and the guide means comprised of at least two parallel rails, and wherein the bollard is a fabrication comprised of vertically disposed tube walls centered in the foundation tube form and with runners slideably engageable with the foundation side walls and at least two parallel runners engageable with at least two rails.

4. The trafficway barrier as set forth in claim 1, wherein the foundation is of tube form fabrication comprised of vertically disposed side walls closed by the bottom and the guide means comprised of at least two peripherally spaced rails, and wherein the bollard is a fabrication comprised of vertically disposed tube walls centered in the foundation tube form and with runners slideably engageable with the foundation side walls and at least three peripherally spaced runners and at least one of which is engageable with one of the aforesaid rails.

5. The trafficway barrier as set forth in claim 1, wherein the foundation is of tube form fabrication comprised of vertically disposed side walls closed by the bottom and the guide means comprised of at least two peripherally spaced rails, and wherein the bollard is a fabrication comprised of vertically disposed tube walls centered in the foundation tube form and with runners slideably engageable with the foundation side walls and at least three peripherally spaced runners and at least two of which are engageable with the opposed faces of two of the aforesaid rails.

6. The trafficway barrier as set forth in claim 1, wherein the foundation is of cylinder tube form comprised of vertically disposed side walls closed by the bottom and the guide means comprised of at least one rail, and wherein the bollard is a fabrication comprised of vertically disposed cylinder tube form with walls centered in the foundation tube form and with runners slideably engageable with the foundation side walls and at least one runner engageable with said at least one rail.

7. The trafficway barrier as set forth in claim 1, wherein the foundation is a cylinder tube form fabrication comprised of vertically disposed side walls closed by the bottom and the guide means comprised of at least two parallel rails, and wherein the bollard is a fabrication comprised of vertically disposed cylinder tube form with walls centered in the foundation tube form and with runners slideably engageable with the foundation side walls and at least two parallel runners engageable with at least two rails.

8. The trafficway barrier as set forth in claim 1, wherein the foundation is of cylinder tube form fabrication comprised of vertically disposed side walls closed by the bottom and the guide means comprised of at least two circumferentially spaced parallel rails, and wherein the bollard is a fabrication comprised of vertically disposed cylinder tube form with walls centered in the foundation tube form and with runners slideably engageable with the foundation side walls and at least three circumferentially spaced runners and at least one of which is engageable with one of the aforesaid rails.

9. The trafficway barrier as set forth in claim 1, wherein the foundation is of cylinder tube form fabrication comprised of vertically disposed side walls closed by the bottom and the guide means comprised of at least two circumferentially spaced parallel rails, and wherein the bollard is a fabrication comprised of vertically disposed cylinder tube form with walls centered in the foundation tube form and with runners slideably engageable with the foundation side walls and at least three circumferentially spaced runners and at least two of which are engageable with the opposed faces of two of the aforesaid rails.

10. The trafficway barrier as set forth in claim 1, wherein a deck plate at the grade level overlies the foundation and mounting frame and has an opening closely fitted around and freely passing the bollard.

11. The trafficway barrier as set forth in claim 1, wherein the accessible open end of the bollard is closed by a removeable cover plate.

12. The trafficway barrier as set forth in claim 1, wherein a deck plate at the grade level overlies the foundation and mounting frame and has an opening closely fitted around and freely passing the bollard, and wherein the accessible open end of the bollard is closed by a removeable cover plate.

13. The trafficway barrier as set forth in claim 1, wherein the controlled power means is comprised of;

an intermittent running motor driven pump means supplying fluid from a reservoir at a variable pressure and a volume rate complementary to the time-demand requirement of the power operable lift means, a pressure-volume accumulator open into a supply line from the motor driven pump means and storing potential energy as fluid volume underflow to high pressure, an instantly reversible valve means in a supply line between the pressure-volume accumulator and a cylinder of the lift means and having two controlled operating positions, an UP position pressuring a lower end and exhausting an upper end of and extending a piston of the lift means, and a DOWN position pressuring the upper end and exhausting the lower end of and retracting the piston of the lift means, a high-low pressure switch open to and responsive to accumulator pressure to close an energizing circuit to the motor at a predetermined low accumulator pressure and to open the energizing circuit at a predetermined high accumulator pressure thereby maintaining a variable pressure and proportionate volume of fluid in the accumulator, a check valve in and preventing reverse flow in the supply line between the motor driven pump means and the pressure-volume accumulator to hold a fluid volume in the accumulator for yielding to retraction of the lift means when moving and when held to said UP position to protect both the lift means and pump means and related structure from hydraulic impact, and control means switching the valve means alternately into said UP and DOWN positions.

14. The trafficway barrier as set forth in claim 13, wherein the valve means discharges into a return to the reservoir from the power operable lift means when in either of said UP and DOWN positions, there being an adjustable flow regulating pressure relief valve means in the return line to the reservoir for yielding to and permitting controlled retraction of the power operable lift means from said UP position and thereby protect it from hydraulic impact.

15. The trafficway barrier as set forth in claim 13, wherein the valve means is a four-way two-position valve with solenoid means responsive to the control means to alternately switch flow of fluid from the supply line to opposite ends of the cylinder of the lift means with the exhaust fluid therefrom to the reservoir, whereby fluid is trapped in the cylinder to positively hold said UP and DOWN positions.

16. The trafficway barrier as set forth in claim 13, wherein the control means includes a selector switch contact for said UP position of the valve means, and alternately a selector switch contact for said DOWN position of the valve means.

17. The trafficway barrier as set forth in claim 13, wherein the valve means is a four-way two-position valve with solenoid means responsive to the control means to alternately switch flow of fluid from the supply line to opposite ends of the cylinder of the lift means with the exhaust fluid therefrom to the reservoir, whereby fluid is simultaneously trapped in the cylinder to positively hold said UP and DOWN positions, wherein the valve means discharges into a return line to the reservoir from the cylinder of the lift means, there being an adjustable flow regulating pressure relief valve means in the return line to the reservoir for permitting controlled retraction of the piston of the lift means from said UP position and thereby protect the power operable lift means from hydraulic impact, and wherein the control means includes a selector switch contact for said UP position of the valve means, and alternately a selector switch contact for said DOWN position of the valve means.

18. The trafficway barrier as set forth in claim 13, wherein a pressure relief valve means in a return line from the power operable lift means to the reservoir yields to retraction of the piston from said UP position and thereby protects the power operable lift means from hydraulic impact.

19. A vertically extensible and retractile bollard type trafficway barrier for arresting vehicles, and including;

a below grade level foundation of substantial depth and having an open upper end at grade level and having first and second vertically disposed guide means at and between said open upper end and a bottom thereof, a mounting frame removeably inserted into the foundation through and suspended from the open upper end of the foundation and engageable with said first guide means for rotatable orientation with respect to direction of vehicular traffic and having a support over the bottom of the foundation, the support having a centered attachment carrying a power operable lift means disposed on a vertical operational axis, a bollard of tube form centered over the power operable lift means and within the foundation and having impact resistant reinforcement means therein and slideably engageable with said second guide means for rotatable orientation of said reinforcement means with respect to the direction of vehicular traffic to absorb impact, the upper end of the bollard being accessible and coupled to a reciprocating rod of the power operable lift means to extend the top of the bollard from a retracted position flush with the grade level.

20. The trafficway barrier as set forth in claim 19 wherein the foundation is of tube form fabrication comprised of vertically disposed side walls and the first and second guide means carried thereby comprised of at least two peripherally spaced rails, wherein the mounting frame depends into the foundation and is rotatably positioned by the first guide means, and wherein the reinforcement means is comprised of vertically disposed tube walls and at least one vertical web disposed in a plane parallel to the direction of vehicular traffic and centered in the foundation tube form and with runners slideably engageable with the foundation side walls and at least three peripherally spaced runners and at least one of which is engageable with the second guide means.

21. The trafficway barrier as set forth in claim 19, wherein the foundation is of tube form fabrication comprised of vertically disposed side walls and the first and second guide means carried thereby comprised of at least two peripherally spaced rails, wherein the mounting frame depends into the foundation and is rotatably positioned by the first guide means, and wherein the reinforcement means is comprised of vertically disposed tube walls and a pair of spaced vertical webs disposed in planes parallel to the direction of vehicular traffic and centered in the foundation tube form and with runners slideably engageable with the foundation side walls and at least three peripherally spaced runners and at least one of which is engageable with the second guide means.

22. The trafficway barrier as set forth in claim 19, wherein the foundation is of tube form fabrication comprised of vertically disposed side walls and the first and second guide means carried thereby comprised of a plurality of peripherally spaced rails, wherein the mounting frame depends into the foundation and is rotatably positioned by opposed faces of a pair of rails comprising the first guide means, and wherein the reinforcement means is comprised of vertically disposed tube walls and at least one vertical web disposed in a plane parallel to the direction of vehicular traffic and centered in the foundation tube form and with runners slideably engageable with the foundation side walls and at least three peripheral spaced runners and at least a pair of which are engageable with opposed faces of a pair of rails comprising the second guide means.

23. The trafficway barrier as set forth in claim 19, wherein the foundation is of cylinder tube form fabrication comprised of vertically disposed side walls and the first and second guide means carried thereby comprised of at least two circumferentially spaced rails, wherein the mounting frame depends into the foundation and is rotatably positioned by the first guide means, and wherein the reinforcement means is comprised of vertically disposed cylinder tube walls and at least one vertical web disposed in a plane parallel to the direction of vehicular traffic and centered in the foundation tube form and with runners slideably engageable with the foundation side walls and at least three circumferentially spaced runners and at least one of which is engageable with the second guide means.

24. The trafficway barrier as set forth in claim 19, wherein the foundation is of cylinder tube form fabrication comprised of vertically disposed side walls and the first and second guide means carried thereby comprised of at least two circumferentailly spaced rails, wherein the mounting frame depends into the foundation and is rotatably positioned by the first guide means, and wherein the reinforcement means is comprised of vertically disposed cylinder tube walls and a pair of spaced vertical webs disposed in planes parallel to the direction of vehicular traffic and centered in the foundation tube form and with runners slideably engageable with the foundation side walls and at least three circumferentially spaced runners and at least one of which is engageable with the second guide means.

25. The trafficway barrier as set forth in claim 19, wherein the foundation is of cylinder tube form fabrication comprised of vertically disposed side walls and the first and second guide means carried thereby comprised of a plurality of circumferentially spaced rails, wherein the mounting frame depends into the foundation and is rotatably positioned by opposed faces of a pair of rails comprising the first guide means, and wherein the reinforcement means is comprised of vertically disposed cylinder tube walls and at least one vertical web disposed in a plane parallel to the direction of vehicular traffic and centered in the foundation tube form with runners slideably engageable with the foundation side walls and at least three circumferentially spaced runners and at least a pair of which are engageable with opposed faces of a pair of rails comprising the second guide means.

26. A vertically extensible and retractile bollard type trafficway barrier for arresting vehicles, and including;

a below grade level foundation of substantial depth and having an open upper end at grade level and having a vertically disposed means extending between said open upper end and a bottom thereof, a mounting frame with guide means and removeably inserted into the foundation through and suspended from the open upper end of the foundation and having a support over the bottom of the foundation, the support having a centered attachment carrying a power operable lift means disposed on a vertical operational axis, a bollard of tube form centered over the power operable lift means and within the foundation and having impact resistant reinforcement means therein and slideably engageable with the guide means for rotatable orientation of said reinforcement means with respect to the direction of vehicular traffice to absorb impact, the upper end of the bollard being accessible and coupled to a reciprocating rod of the power operable lift means to extend the top of the bollard from a retracted position flush with the grade level.

27. The trafficway barrier as set forth in claim 26, wherein the foundation is of tube form fabrication comprised of vertically disposed side walls and the guide means carried thereby comprised of at least one rail, and wherein the reinforcement means is comprised of vertically disposed tube walls and at least one vertical web disposed in a plane parallel to the direction of vehicular traffic and centered in the foundation tube form and with runners slideably engageable with the foundation side walls and at least one of which is engageable with the rail.

28. The trafficway barrier as set forth in claim 26, wherein the foundation is of tube form fabrication comprised of vertically disposed side walls an the guide means carried thereby comprised of at least two peripherally spaced rails, and wherein the reinforcement means is comprised of vertically disposed tube walls and at least one vertical web disposed in a plane parallel to the direction of vehicular traffic and centered in the foundation tube form and with runners slideably engageable with the foundation side walls and which are engageable between opposed faces of the spaced rails.

29. The trafficway barrier as set forth in claim 26, wherein the foundation is of cylinder tube form fabrication comprised of vertically disposed side walls and the guide means carried thereby comprised of at least one rail, and wherein the reinforcement means is comprised of vertically disposed cylinder tube walls and at least one vertical web disposed in a plane parallel to the direction of vehicular traffic and centered in the foundation tube form and with runners slideably engageable with the foundation side walls and at least one of which is engageable with the rail.

30. The trafficway barrier as set forth in claim 26, wherein the foundation is of cylinder tube form fabrication comprised of vertically disposed side walls and the guide means carried thereby comprised of at least two circumferentially spaced rails, and wherein the reinforcement means is comprised of vertically disposed cylinder tube walls and at least one vertical web disposed in a plane parallel to the direction of vehicular traffic and centered in the foundation tube form and with runners slideably engageable with the foundation side walls and which are engageable between opposed faces of the spaced rails.

* * * * *